US009808907B2

(12) United States Patent
Cao et al.

(10) Patent No.: US 9,808,907 B2
(45) Date of Patent: Nov. 7, 2017

(54) POLISHING CLAMP AND POLISHING METHOD USING THE SAME

(71) Applicants: BOE TECHNOLOGY GROUP CO., LTD., Beijing (CN); BOE Optical Science and Technology Co., Ltd., Suzhou, Jiangsu (CN)

(72) Inventors: Keping Cao, Beijing (CN); Feng Zhou, Beijing (CN); Chaozong Chen, Beijing (CN)

(73) Assignees: BOE TECHNOLOGY GROUP CO., LTD., Beijing (CN); BOE OPTICAL SCIENCE AND TECHNOLOGY CO., LTD., Suzhou, Jiangsu (CN)

( * ) Notice: Subject to any disclaimer, the term of this patent is extended or adjusted under 35 U.S.C. 154(b) by 43 days.

(21) Appl. No.: 14/906,459

(22) PCT Filed: Aug. 19, 2015

(86) PCT No.: PCT/CN2015/087513

§ 371 (c)(1),
(2) Date: Jan. 20, 2016

(87) PCT Pub. No.: WO2016/107191

PCT Pub. Date: Jul. 7, 2016

(65) Prior Publication Data

US 2016/0318150 A1 Nov. 3, 2016

(30) Foreign Application Priority Data

Jan. 4, 2015 (CN) ..... 2015 2 0002443 U

(51) Int. Cl.
*B24B 41/00* (2006.01)
*B24B 41/06* (2012.01)

(52) U.S. Cl.
CPC ..... *B24B 41/06* (2013.01)

(58) Field of Classification Search
CPC ..... B24B 7/04; B24B 13/0018; B24B 41/06; B24B 7/19; B24B 7/228; B24B 7/26; B24B 37/08
(Continued)

(56) References Cited

U.S. PATENT DOCUMENTS 1,877,049 A * 9/1932 Raible ..... B22C 21/14 164/399
6,030,282 A * 2/2000 Mahanpour ..... B24B 7/228 451/364
(Continued)

FOREIGN PATENT DOCUMENTS

CN 85105523 A 7/1986
CN 102862112 A 1/2013
(Continued)

OTHER PUBLICATIONS

International Search Report form 210, 220, 237 dated Nov. 12, 2015 issued in corresponding International Application No. PCT/CN2015/087513 along with English translation of the Written Opinion of the International Searthing Authority.

*Primary Examiner* — George Nguyen
(74) *Attorney, Agent, or Firm* — Nath, Goldberg & Meyer; Joshua B. Goldberg

(57) ABSTRACT

A polishing clamp for clamping a work-piece to be polished and a polishing method using the same. The polishing clamp includes a fixing-block for fixing the work-piece to be polished, a recess formed on an end surface of the fixing-block and having the same shape as the work-piece to be polished, the work-piece able to be embedded in the recess, and when the work-piece is placed in the recess, a polished surface of the work-piece to be polished is flush with the end surface of the fixing-block forming the recess. Since a portion of the work-piece to be polished that does not need polish could be prevented from contacting the polishing
(Continued)

apparatus by means of the fixing-block when being polished, the over-wearing may not occur at edges and corners of the work-piece, improving the quality of polishing. This can improve the quality of, e.g., a light guide plate.

18 Claims, 3 Drawing Sheets

(58) Field of Classification Search
USPC ..... 451/28, 286
See application file for complete search history.

(56) References Cited

U.S. PATENT DOCUMENTS

| | | | | |
|---|---|---|---|---|
| 6,821,192 | B1 * | 11/2004 | Donohue | B24B 37/32 451/285 |
| 7,255,637 | B2 * | 8/2007 | Bennett | B24B 37/32 451/286 |
| 2001/0003883 | A1 * | 6/2001 | Denda | B24B 37/30 51/297 |
| 2013/0084783 | A1 * | 4/2013 | Jozaki | B24B 37/08 451/28 |

FOREIGN PATENT DOCUMENTS

| | | | |
|---|---|---|---|
| CN | 202964369 | U | 6/2013 |
| CN | 203171435 | U | 9/2013 |
| CN | 103465165 | A | 12/2013 |
| CN | 203779314 | U | 8/2014 |
| CN | 204366726 | U | 6/2015 |

* cited by examiner

POLISHING CLAMP AND POLISHING METHOD USING THE SAME

This is a National Phase Application filed under 35 U.S.C. 371 as a national stage of PCT/CN2015/087513 filed on Aug. 19, 2015, an application claiming the benefit of Chinese Application No. 201520002443.4 filed on Jan. 4, 2015, the content of each of which is hereby incorporated by reference in its entirety.

FIELD OF THE INVENTION

The disclosure relates to the field of machining technologies, and in particular to a polishing clamp and a polishing method using the same.

BACKGROUND OF THE INVENTION

Light guide plate is a critical member in a backlight module. At present, the light guide plate is generally manufactured by injection moulding. A mould is necessarily used in the injection moulding and a mould core is a key component in the mould. For an optical-grade light guide plate, an optical-grade mirror mould core is necessarily used. In general, the mirror mould core is machined by polishing. Therefore, the quality of the mould core depends on the quality of polishing.

In the process of polishing, a polishing machine and a polishing clamp are necessarily used to polish a work-piece to be processed. The polishing clamp is configured to fix the work-piece to be processed and regulate process conditions. A chuck is generally used in the polishing clamp in the prior art. As shown in FIG. 1, the chuck 11 is fixed to the work-piece to be processed (herein referring to a mould core 12) by screws. When being processed, the mould core 12 is positioned on the polishing machine (not shown) with its machined surface down.

In current processing manners, a portion of the mould core 12 may be slightly caught into polishing buff or polishing cloth due to the gravity action of the chuck 11. With a long-time polishing process, an over-wearing may occur at edges and/or corners of the machining surface of the mould core 12 as circled in FIG. 2. When the light guide plate is injection-moulded, the edge of the light guide plate may be unsmooth with the use of the mould core having above deficiency, thereby degrading the quality of the light guide plate.

SUMMARY OF THE INVENTION

Objectives of this disclosure are to provide a polishing clamp and a polishing method using the same to avoid the over-wearing at edges and corners of the work piece to be polished.

In order to address above technical problems, according to an aspect of the disclosure, there is provided a polishing clamp for clamping a work piece to be polished. The polishing clamp includes a fixing block for fixing the work piece to be polished, a recess is formed on an end surface of the fixing block, the recess has the same shape as the work piece to be polished, such that the work piece to be polished is able to embedded in the recess, and when the work piece to be polished is placed in the recess, a polished surface of the work piece to be polished is flush with the end surface of the fixing block forming the recess.

Preferably, the polishing clamp further includes a pressing block which is positioned on a side of the fixing block oppositely to the recess.

Preferably, the pressing block is fixedly connected to the fixing block.

Preferably, the pressing block is provided with at least one lifting member for placing and removing the pressing block.

Preferably, the pressing block is provided with at least one hole into which the lifting member is fixed at one end thereof.

Preferably, the hole is a threaded hole, while the lifting member is a threaded rod which cooperates with the threaded hole. In this case, a portion of the threaded rod can be fixed into the threaded hole by screwing, while the other portion of the threaded rod is protruded from the surface of the pressing block forming the threaded hole.

Preferably, the polishing clamp further includes an annular member which is able to surround side surfaces of the fixing block and the pressing block.

Preferably, at least one flow-guide opening penetrating through a sidewall of the annular member is formed at an end of the annular member and used to discharge waste liquid generated in the process of polishing to an outside of the annular member.

Preferably, a plurality of flow-guide openings are provided in the annular member and uniformly distributed in a circumferential direction of the annular member.

Preferably, the annular member is higher than the fixing block.

the polishing clamp includes a driving coupler for connecting to a drive device, and the driving coupler is centrally arranged on the pressing block, such that the drive device is able to rotate the fixing block along with the pressing block about a central axis within the annular member.

According to another aspect of the disclosure, there is also provided a polishing method using the polishing clamp as described above, the polishing method including steps of:

Step S1, according to the work piece to be polished, forming the recess having a shape and a size corresponding to the work piece to be polished on the end surface of the fixing block;

Step S2, placing the work piece to be polished in the recess of the fixing block, such that the work piece to be polished is flush with the end surface of fixing block forming the recess;

Step S3, flipping over the fixing block, such that the end surface of the fixing block forming the recess faces down and is supported by a polishing apparatus; and Step S4, polishing the work piece to be polished in the recess of the fixing block by the polishing apparatus.

According to the polishing clamp provided in the embodiments of the disclosure, since a portion of the work piece to be polished that does not need to polish could be prevented from contacting the polishing apparatus by means of the fixing block, the over-wearing may not occur at edges and corners of the work piece to be polished, thereby improving the quality of polishing. When the work piece to be polished is the mould core for injection-moulding the light guide plate, the quality of the light guide plate can be improved according the embodiments of the disclosure.

BRIEF DESCRIPTION OF THE DRAWINGS

Accompanying drawings are provided for further understanding of this disclosure and constituting a part of the specification. Hereinafter, these drawings are intended to explain the disclosure together with the following specific embodiments, but should not be considered as a limitation of the disclosure. In which.

Figure 1:
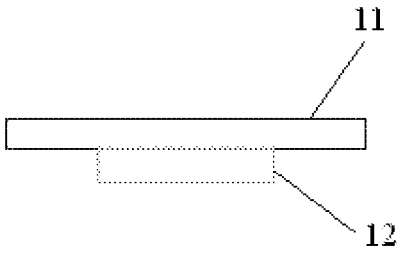
FIG. 1 is a schematic diagram of the polishing clamp in the prior art.
Figure 2:
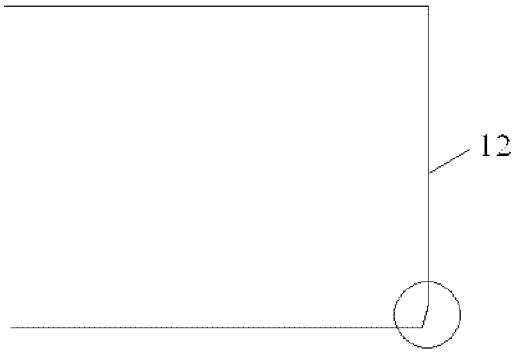
FIG. 2 is a schematic diagram showing the over-wearing at the edge of the machining surface after being processed by the polishing clamp in the prior art.

In reference numerals, 11—chuck; 12—mould core; 13—fixing block; 14—recess; 15—pressing block; 16—hole; 17—lifting member; 18—annular member; 19—flow-guide openings: and A—driving coupler.

DETAILED DESCRIPTION OF THE EMBODIMENTS

Hereinafter, specific embodiments of the disclosure will be described in detail in conjunction with the accompanying drawings. It should be understood that the specific embodiments as set forth herein are merely for the purpose of illustration and explanation of the disclosure and should not be constructed as a limitation thereof.

Figure 3:
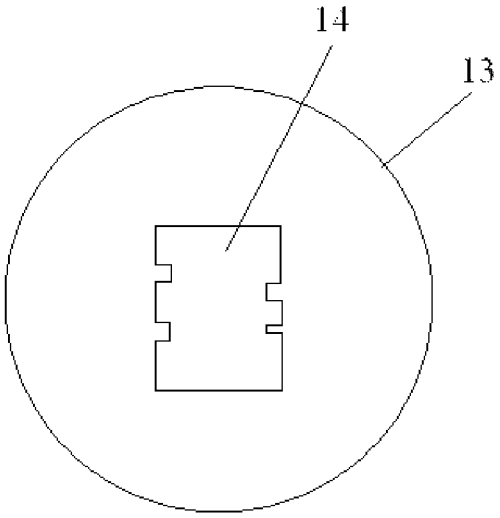
FIG. 3 is a schematic plan view of a fixing block of a polishing clamp according to an embodiment of the disclosure.
Figure 4:
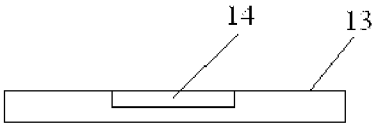
FIG. 4 is a schematic cross-section of the fixing block of the polishing clamp according to the embodiment of the disclosure.

There is provided a polishing clamp in the embodiment of the disclosure, which is used to clamp a work piece to be polished. As shown in FIGS. 3 and 4, the polishing clamp may include a fixing block 13 for fixing the work piece to be polished (not shown in figures). A recess 14 is formed on an end surface of the fixing block 13. The recess 14 has a shape in conformity with the work piece to be polished, such that the work piece to be polished can be embedded in the recess 14. When the work piece to be polished is placed in the recess 14, a polished surface of the work piece to be polished is flush with the end surface of the fixing block 13 forming the recess 14.

Material of the fixing block 13 preferably may be plastic or bakelite which is easily machined to form the recess 14.

In the embodiment of the disclosure, when the work piece to be polished is being machined, first the recess 14 having a shape and a size corresponding to the work piece to be polished is formed on the fixing block 13 according to the work piece to be polished; the work piece to be polished is placed in the recess 14 of the fixing block 13, such that the polished surface of the work piece to be polished is flush with the end surface of the fixing block 13; and then the fixing block 13 is flipped over, such that the end surface of the fixing block 13 forming the recess 14 faces down and is supported by a polishing apparatus. In this state, the work piece to be polished in the recess 14 of the fixing block 13 can be polished by the polishing apparatus. Since the work piece to be polished is placed in the recess 14 of the fixing block 13 when it is being polished, a portion of the work piece to be polished that does not need to polish could be prevented from contacting the polishing apparatus. Therefore, the over-wearing may not occur at edges and corners of the work piece to be polished.

The work piece to be polished in the embodiment of the disclosure may be a mould core for injection-moulding the light guide plate. Since the over-wearing at edges and corners of the mould core can be eliminated in the embodiment of the disclosure, unsmooth edges of the light guide plate which will be injection-moulded with the use of the mould core can be avoided, thereby improving the quality of the light guide plate. In addition, since the recess 14 is designed according to the shape and the size of the work piece to be polished, the polishing clamp in the embodiment of the disclosure can be adapted to the work piece to be polished having any shapes and sizes.

Figure 5:
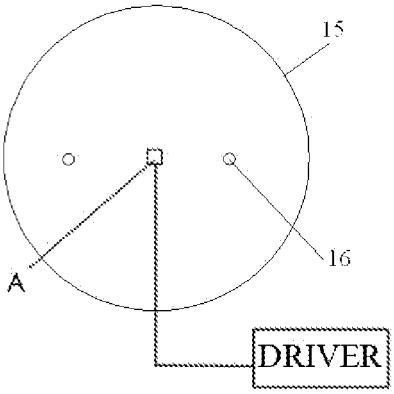
FIG. 5 is a schematic plan view of a pressing block of the polishing clamp according to the embodiment of the disclosure.
Figure 6:
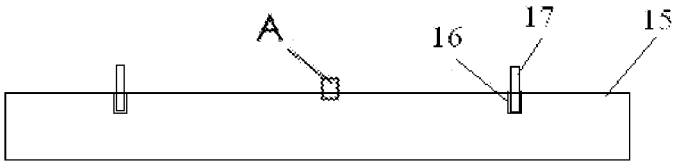
FIG. 6 is a schematic cross-section of the pressing block of the polishing clamp according to the embodiment of the disclosure.

Moreover, as shown in FIGS. 5 and 6, the polishing clamp may further include a pressing block 15 which is positioned on a side of the fixing block 13 oppositely to the recess 14. The pressing block 15 is used to press the fixing block 13 on the polishing apparatus to keep the fixing block 13 immobile. Preferably, the pressing block 15 can be fixedly connected to the fixing block 13, such that both of them are immovable with respect to each other in the process of polishing.

The pressing block 15 is preferably made of metal material (for example, iron). In addition, the pressing block 15 is preferably heavier than the fixing block 13, in order to more stably press the fixing block 13 on the polishing apparatus.

Moreover, the pressing block 15 is provided with at least one lifting member 17 for placing and removing the pressing block 15. In particular, for example, the pressing block 15 is provided with at least one hole 16 into which the lifting member 17 is fixed at one end thereof. As an example, the hole 16 can be a threaded hole, while the lifting member 17 can be a threaded rod to match with the threaded hole. In this case, a portion of the threaded rod can be fixed into the threaded hole by screwing, while the other portion of the threaded rod is protruded from the surface of the pressing block 15 forming the threaded hole. An operator can easily place and remove the pressing block 15 by means of the lifting member.

Figure 7:
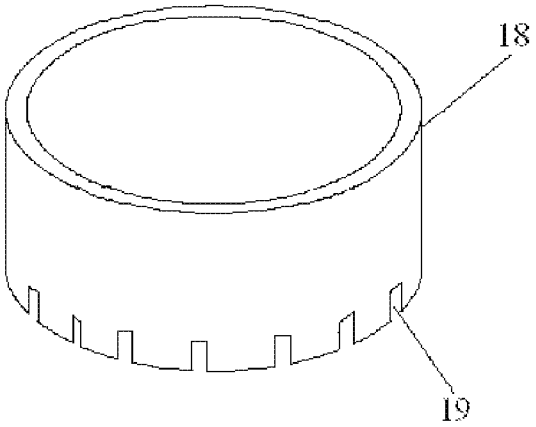
FIG. 7 is a schematic perspective view of an annular member of the polishing clamp according to the embodiment of the disclosure.
Figure 8:
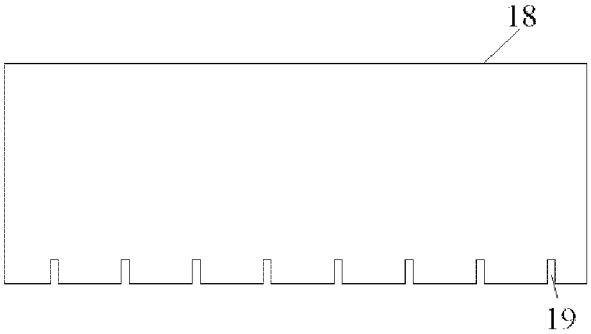
FIG. 8 is a schematic cross-section of the annular member of the polishing clamp according to the embodiment of the disclosure.
Figure 9:
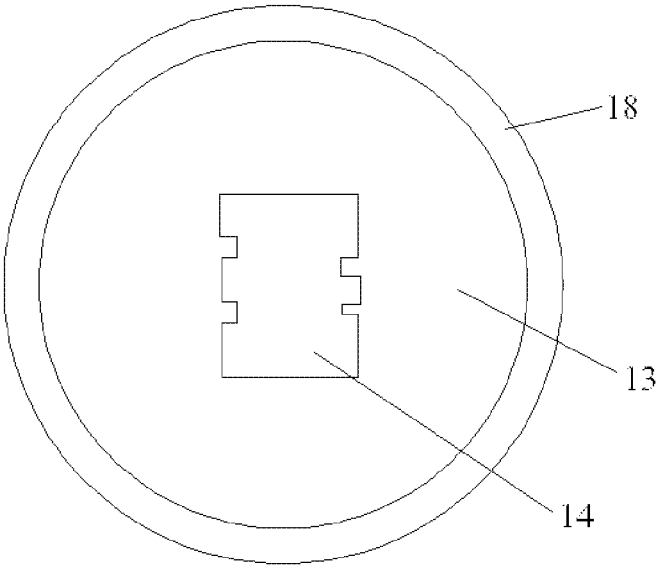
FIG. 9 is a schematic plan view of the assembled polishing clamp according to the embodiment of the disclosure.

Moreover, as shown in FIGS. 7-9, the polishing clamp may further include an annular member 18 which is able to surround side surfaces of the fixing block 13 and the pressing block 15. The annular member 18 is preferably higher than the fixing block 13, such that the annular member 18 can be used to support the side surfaces of the fixing block 13 and the pressing block 15. In such a manner, the structural strength of the polishing clamp can be enhanced to effectively prevent the fixing block 13 and the pressing block 15 from offsetting in the process of polishing.

In the implementation of the disclosure, each of the fixing block 13 and the pressing block 15 has a circular outer contour. It should be explained that the fixing block 13 and the pressing block 15 may be formed into other geometric shapes, such as triangle and quadrangle. Accordingly, the annular member 18 may be formed in other geometric shapes in conformity with the fixing block 13 and the pressing block 15. However, in the light of the processing difficulty and the cost of expense, the fixing block 13, the pressing block 15 and the annular member 18 are preferably circular; the fixing block 13 and the pressing block 15 have the same outer diameter; and an inner diameter of the annular member 18 is equal to the outer diameters of the fixing block 13 and the pressing block 15. When the work piece to be polished is being machined, each of the fixing block 13 and the pressing block 15 can be positioned within the annular member 18.

In the process of polishing, liquid such as water is usually used to cool the polishing apparatus and the work piece to be polished. In order to avoid gathering the liquid within the annular member 18, preferably, at least one flow-guide opening 19 penetrating through a sidewall of the annular member 18 is formed at an end of the annular member 18 (i.e., the end proximal to the polishing apparatus). The flow-guide opening 19 is used to discharge waste liquid generated in the process of polishing to the outside of the annular member 18. In such a manner, it is possible to immediately discharge the waste liquid from the annular member 18, thereby assisting in dropping temperature of the polishing apparatus and the work piece to be polished and discharging residuals generated in the process of polishing.

Moreover, a plurality of flow-guide openings 19 are provided in the annular member 18 and uniformly distributed in a circumferential direction of the annular member 18.

In order to improve the efficiency of polishing, the polishing clamp further includes a driving coupler A for connecting to a drive device. The driving coupler A may be centrally arranged on the pressing block 15, such that the drive device can rotate the fixing block 13 along with the pressing block 15 about a central axis within the annular member 18. The fixing block 13 and the pressing block 15 may have a reverse rotational direction in relation to the rotational direction of an abrasive of the polishing apparatus. In such a manner, it is possible to increase the speed of relative rotation, thereby improving the efficiency of polishing.

According to another aspect of the disclosure, there is also provided a polishing method using above polishing clamp, which may include steps of:

Step S1, according to the work piece to be polished, forming the recess 14 having a shape and a size corresponding to the work piece to be polished on the end surface of the fixing block 13;

Step S2, placing the work piece to be polished in the recess 14 of the fixing block 13, such that the polished surface of the work piece to be polished is flush with the end surface of fixing block 13 forming the recess 14;

Step S3, flipping over the fixing block 13, such that the end surface of the fixing block 13 forming the recess 14 faces down and is supported by a polishing apparatus; and Step S4, polishing the work piece to be polished in the recess 14 of the fixing block 13 by the polishing apparatus.

In addition, prior to Step S4, the method may further include: fixedly connecting the pressing block 15 to the fixing block 13, and surrounding side surfaces of the pressing block 15 and the fixing block 13 by an annular member 18.

According to the embodiments of the disclosure, the over-wearing at edges and corners of the work piece to be polished can be eliminated, thereby improving the quality of polishing. When the work piece to be polished is the mould core for injection-moulding the light guide plate, the quality of the light guide plate can be improved according the embodiments of the disclosure.

It should be understood that the above implementations are merely exemplary embodiments for the purpose of illustrating the principle of the disclosure, and the disclosure is not limited thereto. Various modifications and improvements can be made by a person having ordinary skill in the art without departing from the spirit and essence of the disclosure. Accordingly, all of the modifications and improvements also fall into the protection scope of the disclosure.

The invention claimed is:

1. A polishing clamp for clamping a work piece to be polished, wherein the polishing clamp includes a fixing block for fixing the work piece to be polished, a recess is formed on an end surface of the fixing block, the recess has the same shape as the work piece to be polished, such that the work piece to be polished is able to be embedded in the recess, when the work piece to be polished is placed in the recess, a polished surface of the work piece to be polished is flush with the end surface of the fixing block forming the recess, the polishing clamp further includes a pressing block which is positioned on a side of the fixing block oppositely to the recess, and the pressing block is provided with at least one lifting member for placing and removing the pressing block.

2. The polishing clamp according claim 1, wherein the pressing block is fixedly connected to the fixing block.

3. The polishing clamp according to claim 1, wherein the pressing block is provided with at least one hole into which the lifting member is fixed at one end thereof.

4. The polishing clamp according to claim 1, wherein the polishing clamp further includes an annular member which is able to surround side surfaces of the fixing block and the pressing block.

5. The polishing clamp according to claim 4, wherein at least one flow-guide opening penetrating through a sidewall of the annular member is formed at an end of the annular member and used to discharge waste liquid generated in the process of polishing to an outside of the annular member.

6. The polishing clamp according to claim 5, wherein a plurality of flow-guide openings are provided in the annular member and uniformly distributed in a circumferential direction of the annular member.

7. The polishing clamp according to claim 4, wherein the annular member is higher than the fixing block.

8. The polishing clamp according to claim 4, wherein the polishing clamp includes a driving coupler for connecting to a drive device, and the driving coupler is centrally arranged on the pressing block, such that the drive device is able to rotate the fixing block along with the pressing block about a central axis within the annular member.

9. A polishing method using the polishing clamp according to claim 1, wherein the polishing method includes steps of:

Step S1, according to the work piece to be polished, forming the recess having a shape and a size corresponding to the work piece to be polished on the end surface of the fixing block;

Step S2, placing the work piece to be polished in the recess of the fixing block, such that the work piece to be polished is flush with the end surface of fixing block forming the recess;

Step S3, flipping over the fixing block, such that the end surface of the fixing block forming the recess faces down and is supported by a polishing apparatus; and Step S4, polishing the work piece to be polished in the recess of the fixing block by the polishing apparatus.

10. The polishing method according to claim 9, wherein the polishing clamp further includes a pressing block which is positioned on a side of the fixing block oppositely to the recess.

11. The polishing method according to claim 10, wherein the pressing block is fixedly connected to the fixing block.

12. The polishing method according to claim 10, wherein the pressing block is provided with at least one lifting member for placing and removing the pressing block.

13. The polishing method according to claim 12, wherein the pressing block is provided with at least one hole into which the lifting member is fixed at one end thereof.

14. The polishing method according to claim 10, wherein the polishing clamp further includes an annular member which is able to surround side surfaces of the fixing block and the pressing block.

15. The polishing method according to claim 14, wherein at least one flow-guide opening penetrating through a sidewall of the annular member is formed at an end of the annular member and used to discharge waste liquid generated in the process of polishing to an outside of the annular member.

16. The polishing method according to claim 15, wherein a plurality of flow-guide openings are provided in the annular member and uniformly distributed in a circumferential direction of the annular member.

17. The polishing method according to claim 14, wherein the annular member is higher than the fixing block.

18. The polishing method according to claim 14, wherein the polishing clamp includes a driving coupler for connecting to a drive device, and the driving coupler is centrally arranged on the pressing block, such that the drive device is able to rotate the fixing block along with the pressing block about a central axis within the annular member.

* * * * *